US012723761B2

(12) United States Patent
Bierbaum

(10) Patent No.: US 12,723,761 B2
(45) Date of Patent: Sep. 1, 2026

(54) BRACKET ASSEMBLY FOR A GAS MANIFOLD OF A RANGE APPLIANCE

(71) Applicant: Haier US Appliance Solutions, Inc., Wilmington, DE (US)

(72) Inventor: Charles Andrew Bierbaum, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 368 days.

(21) Appl. No.: 18/403,267

(22) Filed: Jan. 3, 2024

(65) Prior Publication Data

US 2025/0216084 A1 Jul. 3, 2025

(51) Int. Cl.
*F24C 3/12* (2006.01)
*F24C 3/00* (2006.01)

(52) U.S. Cl.
CPC ..... *F24C 3/126* (2013.01); *F24C 3/008* (2013.01)

(58) Field of Classification Search
CPC ..... F24C 3/126; F24C 3/008
See application file for complete search history.

(56) References Cited

U.S. PATENT DOCUMENTS 7,490,628 B2 2/2009 Frost et al.
9,476,594 B2 10/2016 Fockler
10,619,859 B2 * 4/2020 Zambruni ..... F24C 3/022
10,677,470 B2 * 6/2020 Beghi ..... F24C 3/008
11,175,038 B2 * 11/2021 Fox ..... F24C 3/085
2005/0257784 A1 * 11/2005 Albizuri ..... F24C 3/12 126/41 R
2017/0089586 A1 * 3/2017 Turner ..... F24C 3/126
2023/0136332 A1 * 5/2023 Pierce ..... F24C 3/124 126/39 R
2023/0296255 A1 * 9/2023 Pierce ..... F24C 3/124 126/39 R

* cited by examiner

*Primary Examiner* — Jesse S Bogue
(74) *Attorney, Agent, or Firm* — Dority & Manning, P.A.

(57) ABSTRACT

A range appliance may define a vertical direction, a lateral direction, and a transverse direction. The range appliance may include a cabinet defining a cooking chamber. The range appliance may also include a cooktop assembly positioned at a top portion of the cabinet. The range appliance may further include a gas manifold assembly provided at the cooktop assembly. The gas manifold assembly may include a manifold pipe through which fuel is supplied to the cooktop assembly. The gas manifold assembly may also include a bracket assembly. The bracket assembly may include a manifold bracket and a panel bracket. The manifold bracket may be directly coupled to the manifold pipe. The panel bracket may be removably coupled to the manifold bracket. The panel bracket may include one or more locating features to locate the gas manifold assembly to the cooktop assembly.

20 Claims, 6 Drawing Sheets

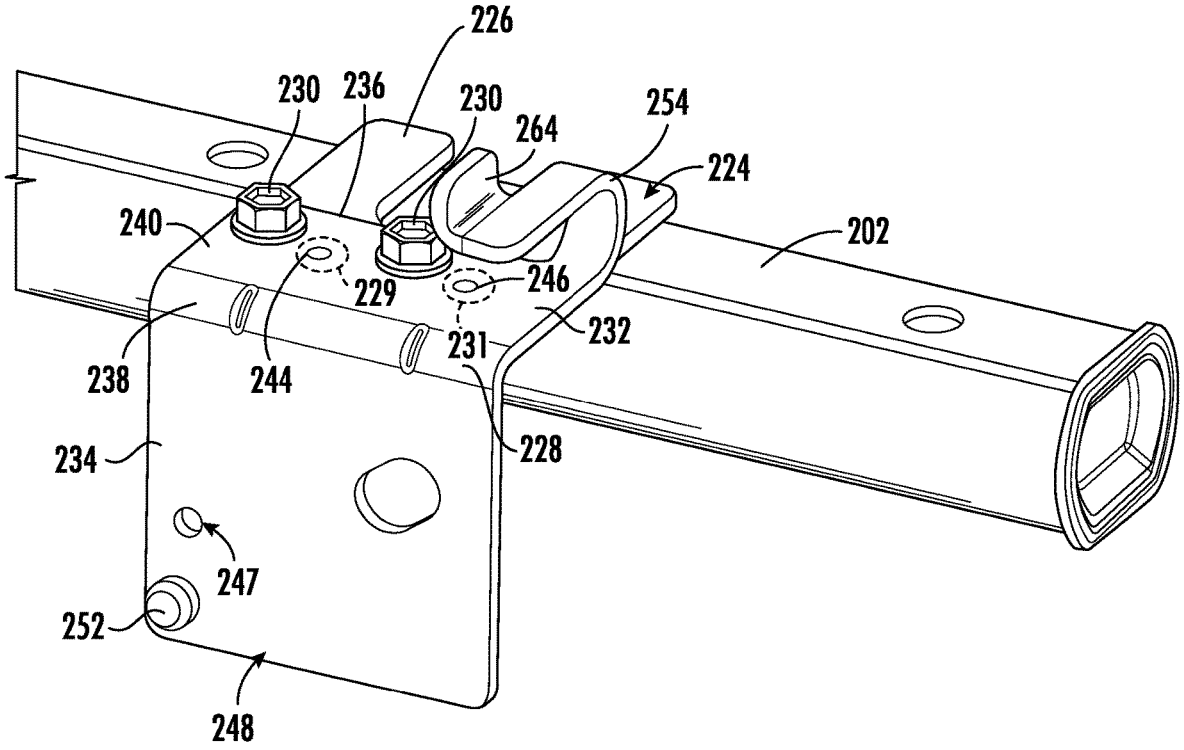
FIG. 4
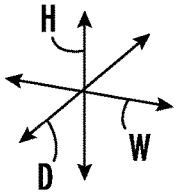

BRACKET ASSEMBLY FOR A GAS MANIFOLD OF A RANGE APPLIANCE

FIELD OF THE DISCLOSURE

The present subject matter relates generally to range appliances and more particularly to a gas manifold assembly of a range appliance.

BACKGROUND OF THE DISCLOSURE

Certain cooking appliances can include a cooktop having a plurality of heating elements. For instance, one or more gas burners may be provided on the cooktop. Combustion of fuel at the gas burners can heat pots, pans, griddles, etc. To regulate fuel flow to the gas burners, known gas burners are connected to a valve with a knob. A user turns the knob to regulate fuel flow to the associated gas burner. Accordingly, a switch harness may be provided at or near the knobs to assist or drive the fuel flow or power (e.g., fuel) supply to the burners.

Challenges related to the mounting or servicing of the valves or the switch harness within such cooking appliances exist. For instance, the valves and switch harness can be coupled to a gas manifold pipe. The weight of the gas manifold pipe (and additional components of a gas manifold assembly that the manifold pipe can be incorporated into) may result in sagging of the gas manifold pipe that can lead to difficulties for a technician. Specifically, the sagging can make it difficult for a technician to fit valves stems of each respective valve through a manifold panel of the cooking appliance. Moreover, a disconnection from a gas supply line may be required to properly access the switches of the switch harness that may be required to be serviced. This may lead to potential damage to the gas line.

Accordingly, a bracket assembly that obviates one or more of the above-mentioned drawbacks would be beneficial.

BRIEF DESCRIPTION OF THE DISCLOSURE

Aspects and advantages of the invention will be set forth in part in the following description, or may be obvious from the description, or may be learned through practice of the invention.

In one exemplary aspect of the present disclosure, a range appliance is provided. The range appliance may define a vertical direction, a lateral direction, and a transverse direction. The range appliance may include a cabinet defining a cooking chamber. The range appliance may also include a cooktop assembly positioned at a top portion of the cabinet. The cooktop assembly may include a cooktop. The cooktop may include a cooktop front panel extending along the vertical direction. The cooktop may further include a cooktop return flange extending from the cooktop front panel along the transverse direction. The range appliance may further include a gas manifold assembly provided at the cooktop assembly. The gas manifold assembly may include a manifold pipe through which fuel is supplied to the cooktop assembly. The gas manifold assembly may also include a bracket assembly. The bracket assembly may include a manifold bracket and a panel bracket. The manifold bracket may be directly coupled to the manifold pipe. The panel bracket may be removably coupled to the manifold bracket. The panel bracket may include one or more locating features to locate the gas manifold assembly to the cooktop assembly.

In another exemplary aspect of the present disclosure, a gas manifold assembly for a range appliance is provided. The range appliance may define a vertical direction, a lateral direction, and a transverse direction. The range appliance may include a cabinet defining a cooking chamber and a cooktop assembly positioned at a top portion of the cabinet. The gas manifold assembly may include a manifold pipe through which fuel is supplied to the cooktop assembly. The gas manifold assembly may also include a bracket assembly. The bracket assembly may include a manifold bracket and a panel bracket. The manifold bracket may be directly coupled to the manifold pipe. The panel bracket may be removably coupled to the manifold bracket. The panel bracket may include one or more locating features to locate the gas manifold assembly to the cooktop assembly.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 4 provides a close-up perspective view of a bracket assembly and a manifold pipe according to one or more exemplary aspects of the present subject matter.

Figure 1:
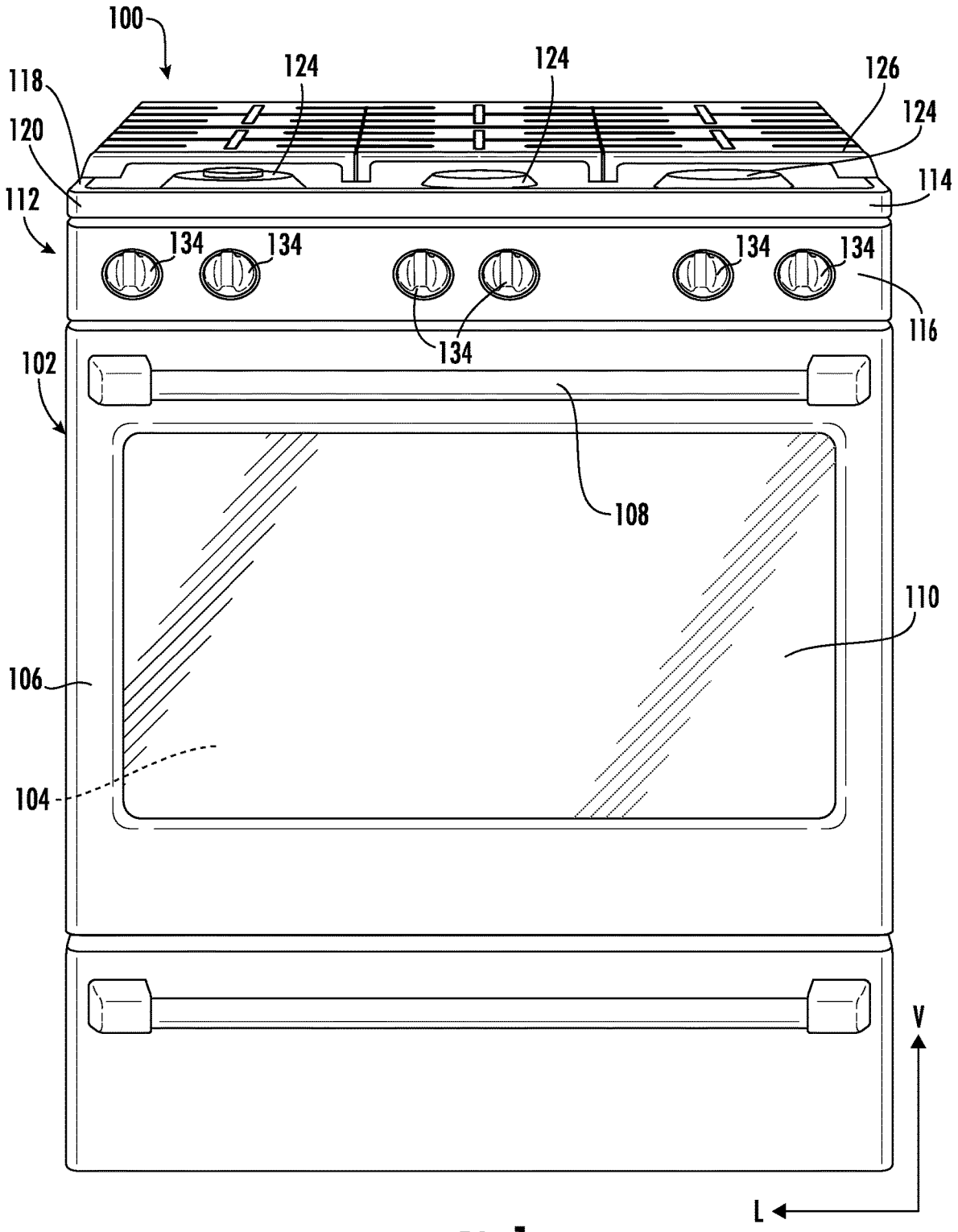
FIG. 1 provides a front perspective view of a range appliance according to one or more exemplary aspects of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a ten percent margin, e.g., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations.

Turning now to the figures, FIG. 1 provides a perspective view of a cooking appliance, such as a range appliance 100, according to exemplary embodiments of the present disclosure. Generally, range appliance 100 defines a vertical direction V, a lateral direction L, and a transverse direction T. The vertical direction V, lateral direction L, and transverse direction T are mutually perpendicular and form an orthogonal direction system. As will be understood, range appliance 100 is provided by way of example only, and the present subject matter may be used in any suitable appliance. Thus, the present disclosure may be used with other oven, range, or cooking appliance configurations (e.g., configurations that define multiple interior cavities for the receipt of food, include no interior cavities, or are otherwise different than the configuration shown in FIG. 1), as well as other suitable appliances, as would be understood in light of the present disclosure.

The exemplary range appliance 100 may include an insulated cabinet 102 with an interior cooking chamber 104 defined by an interior surface of cabinet 102. Cooking chamber 104 is configured for the receipt of one or more food items to be cooked. Range appliance 100 includes a door 106 rotatably mounted to cabinet 102 (e.g., with a hinge—not shown). A handle 108 may be mounted to door 106 and may assist a user with opening and closing door 106 in order to access an opening to cooking chamber 104. For example, a user can pull on handle 108 to open or close door 106 and access cooking chamber 104 through the opening. As would be understood, one or more internal heating elements (e.g., baking or broiling heating elements) may be provided within cooking chamber 104 to cook or otherwise heat items therein.

Range appliance 100 can include a seal (not shown) between door 106 and cabinet 102 that assist with maintaining heat and cooking fumes within cooking chamber 104 when door 106 is closed, as shown in FIG. 1. One or more parallel glass panes 110 provide for viewing the contents of cooking chamber 104 when door 106 is closed and assist with insulating cooking chamber 104. Optionally, a baking rack (not pictured) may be positioned in cooking chamber 104 for the receipt of food items or utensils containing food items.

Range appliance 100 may include a cooktop assembly 112 positioned at, or adjacent, a top portion of the cabinet 102. In some embodiments, the cooktop assembly 112 includes a cooktop 114 and a manifold panel 116. Generally, the cooktop 114 may include a top panel 118 defining a top surface of the cooktop 114, a cooktop front panel 120 defining a front surface of the cooktop 114, and a cooktop return flange 122 (see, e.g., FIG. 6). The cooktop front panel 120 may extend from the top panel 118 of the cooktop 114 downward approximately along the vertical direction V. The cooktop return flange 122 may extend inward (e.g., toward a rear of the range appliance 100) approximately along the transverse direction T.

In some exemplary embodiments, the cooktop 114 may be formed from any suitable metal material (e.g., steel). In other embodiments, however, cooktop 114 includes another suitable material, such as a ceramic glass or another suitable non-metallic material.

The cooktop 114 may include one or more burner assemblies 124 for use in heating or cooking operations. Burner assemblies 124 may provide thermal energy to cooking utensils on grates 126. Burner assemblies 124 may be configured in various sizes so as to provide e.g., for the receipt of cooking utensils (e.g., pots, pans, etc.) of various sizes and configurations and to provide different heat inputs for such cooking utensils. Grates 126 may be supported on any suitable surface defined by the top panel 118. For example, as illustrated, grates 126 may be supported on the top surface defined by the top panel 118. A utensil holding food or cooking liquids (e.g., oil, water, etc.) may be placed onto grates 126 at a location of any of the burner assemblies 124. Optionally, range appliance 100 may include a griddle burner (not depicted) positioned at a middle portion of cooktop 114. In such instances, a griddle may be positioned on grates 126 and heated with the griddle burner.

Figure 2:
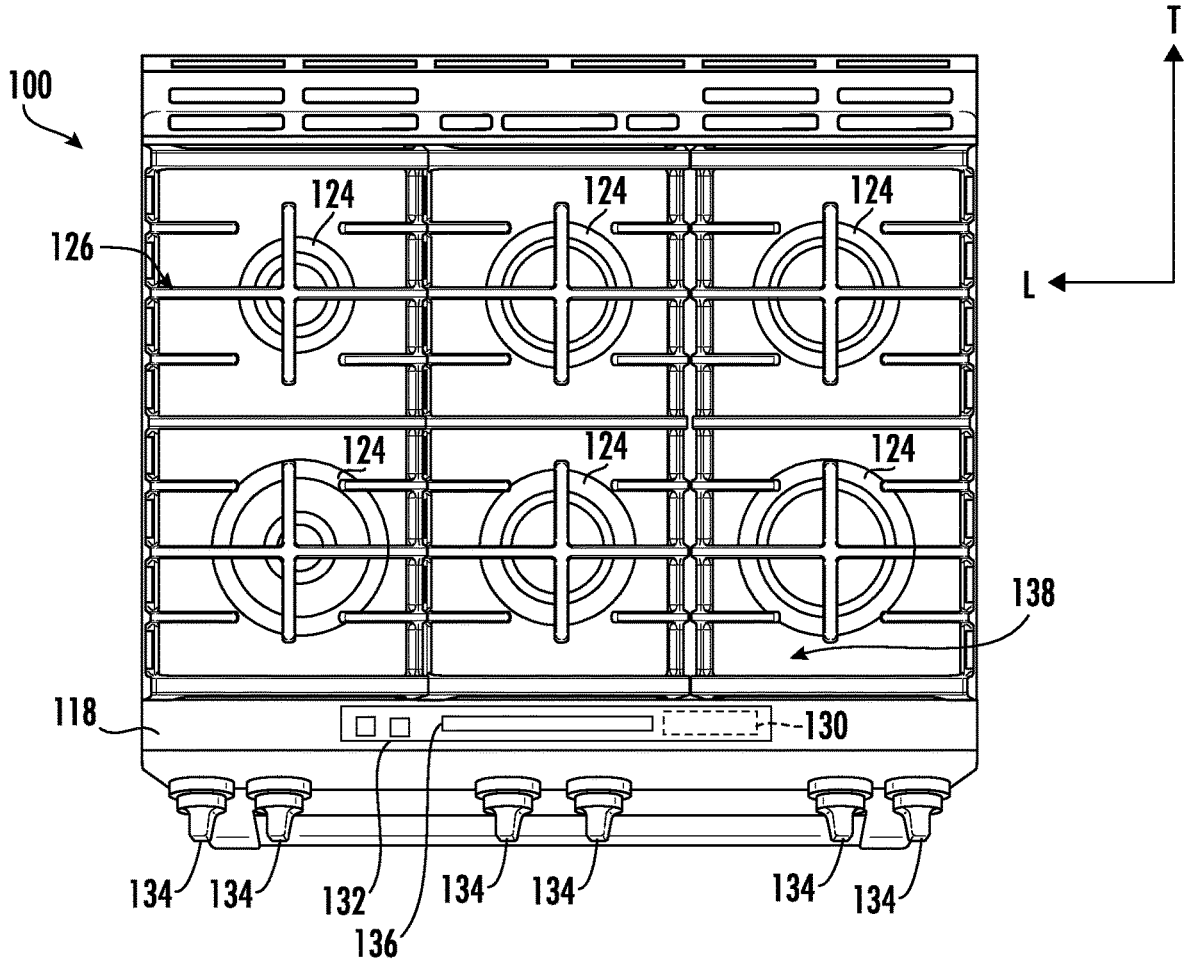
FIG. 2 provides a top view of the exemplary range appliance of FIG. 1.

Some embodiments of range appliance 100 include a controller 130 (see, e.g., FIG. 2). The controller 130 may be configured to control one or more operations of range appliance 100. For example, controller 130 may control at least one operation of range appliance 100 that includes an internal heating element or burner assemblies 124. Controller 130 may be in communication (via for example a suitable wired or wireless connection) with one or more of the burner assemblies 124 and other suitable components of range appliance 100, as discussed herein. In general, controller 130 may be operable to configure range appliance 100 (and various components thereof) for cooking. Such configuration may be based, for instance, on a plurality of cooking factors of a selected operating cycle or mode.

By way of example, controller 130 may include one or more memory devices and one or more microprocessors, such as general or special purpose microprocessors operable to execute programming instructions or micro-control code associated with an operating cycle. The memory may represent random access memory such as DRAM, or read only memory such as ROM or FLASH. In one embodiment, the processor executes programming instructions stored in memory. The memory may be a separate component from the processor or may be included onboard within the processor.

Referring now to FIG. 2, a top view of the range appliance 100 of FIG. 1 is provided. As should be appreciated, the controller 130 may be positioned in a variety of locations throughout range appliance 100. For instance, as illustrated, the controller 130 may be positioned or located within a user interface assembly 132 of range appliance 100. In some embodiments, the user interface assembly 132 includes a display component 136, such as a digital or analog display configured to provide operational feedback to a user. In some such embodiments, input/output ("I/O") signals can be routed between controller 130 and various operational components of range appliance 100, such as burner assemblies 124, control knobs 134, display component 136, sensors, alarms, or other components as may be provided. For instance, signals may be directed along one or more wiring harnesses that may be routed through cabinet 102. In some embodiments, controller 130 is in communication with user interface assembly 132 and control knobs 134 through which a user may select various operational features and modes and monitor progress of range appliance 100. In one embodiment, user interface assembly 132 represents a general purpose I/O ("GPIO") device or functional block. In one embodiment, user interface assembly 132 includes input components, such as one or more of a variety of electrical, mechanical, or electro-mechanical input devices including rotary dials, push buttons, and touch pads.

As described above, cooktop 114 may include a plurality of burner assemblies 124 and a top panel 118. At least a portion of top panel 118 may be concave (e.g., downward along the vertical direction V) to form a depression or cavity 138 therein. Thus, burner assemblies 124 may be provided within the cavity 138, and cooking grates 126 may be positioned over top of the burner assemblies 124 (e.g., along the vertical direction V). In this example, cooktop 114 includes six burner assemblies 124. It should be noted that the disclosure is not limited to this, and cooktop 114 may include fewer or more burner assemblies 124 as specific applications dictate.

Figure 3:
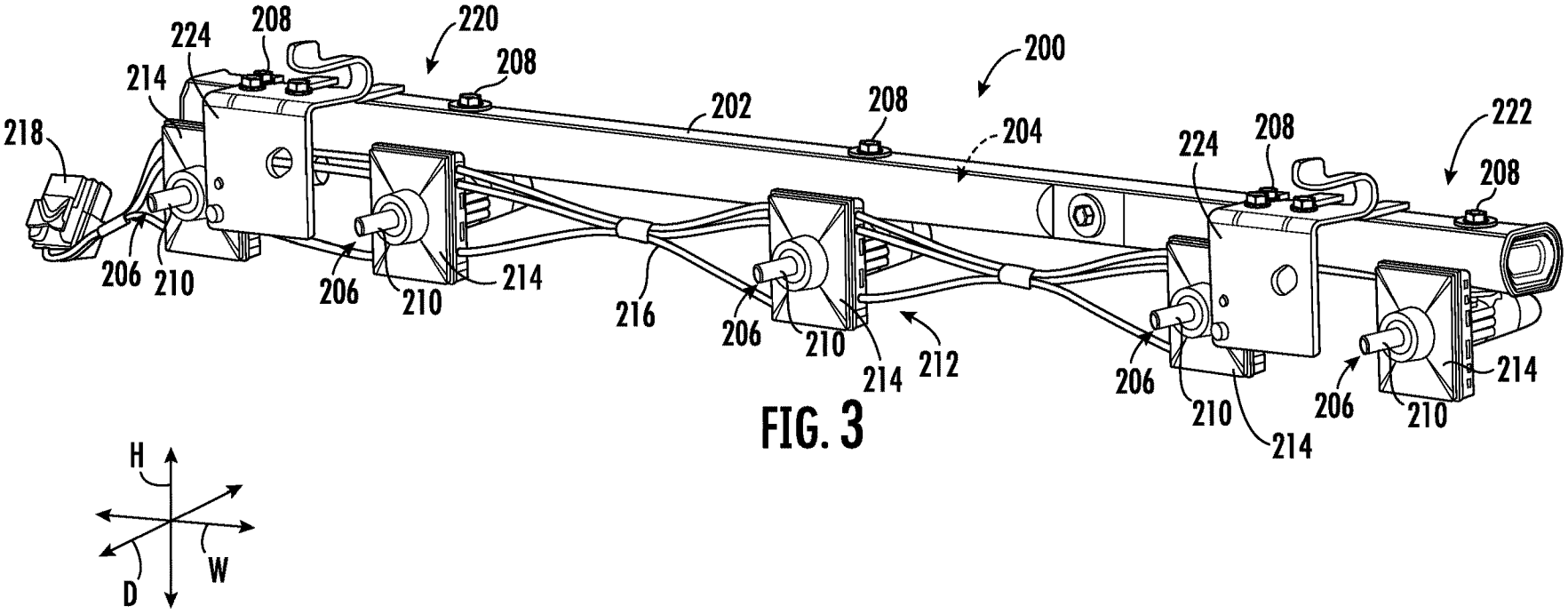
FIG. 3 provides a perspective view of a gas manifold assembly according to one or more exemplary aspects of the present subject matter.

Referring now to FIG. 3, a perspective view of a gas manifold assembly 200 according to one or more exemplary aspects of the present subject matter is provided. With reference to FIGS. 3 through 6, gas manifold assembly 200 may define a vertical direction H, a lateral direction W, and a transverse direction D. It should be noted that the coordinates defined herein apply to gas manifold assembly 200 and may or may not be equivalent to the vertical direction V, lateral direction L, and transverse direction T defined by range appliance 100. In some instances (e.g., during mounting or servicing), the gas manifold assembly 200 may be positioned within range appliance 100 in a tilted manner, such that transverse direction D of the gas manifold assembly 200 is provided at an acute angle with respect to the transverse direction T of range appliance 100.

In some embodiments, the gas manifold assembly 200 is provided at the cooktop assembly 112. For instance, the gas manifold assembly 200 may be enclosed or covered, at least in part, by the cooktop assembly 112. In particular, the manifold panel 116 be utilized to cover the gas manifold assembly 200. The manifold panel 116 may be removable from the cooktop assembly 112 and selectively attached to the gas manifold assembly 200. In addition, the gas manifold assembly 200 may be a control assembly for the range appliance 100. For instance, the gas manifold assembly 200 may be utilized to selectively control a flow of fuel (e.g., natural gas, propane, etc.) to the one or more burner assemblies 124.

In some embodiments, the gas manifold assembly 200 includes a manifold pipe 202. For instance, manifold pipe 202 may be a gas pipe through which fuel (e.g., natural gas, propane, etc.) is supplied to the one or more burner assemblies 124. The manifold pipe 202 may define a channel 204 through which gas supplied to range appliance 100 (e.g., from a municipal gas source) may be selectively distributed to at least one of burner assemblies 124.

Figure 6:
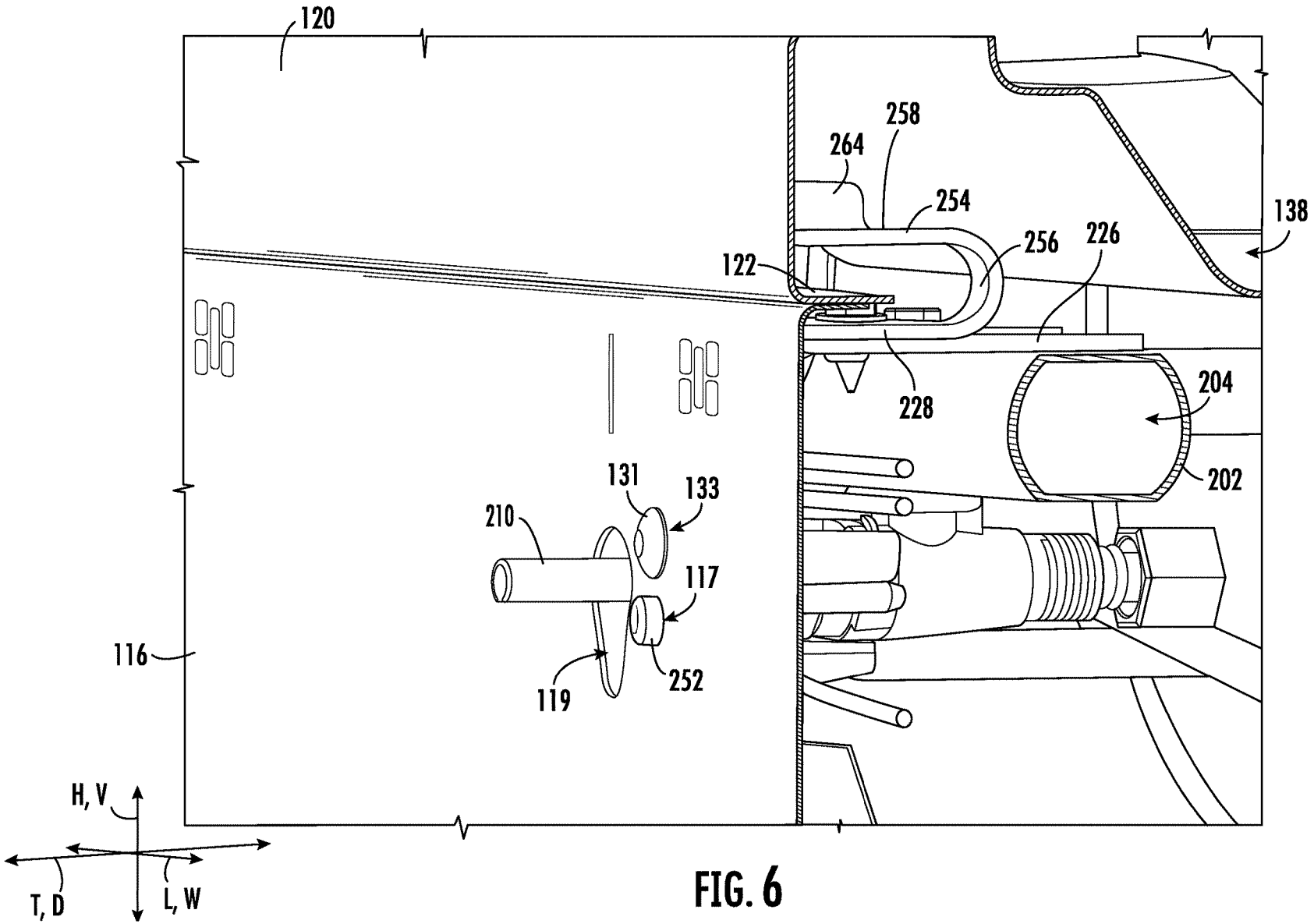
FIG. 6 provides a cutaway view of a cooktop assembly of the exemplary range appliance of FIG. 1 with control knobs removed.

A plurality of valves 206 may be coupled to manifold pipe 202. For instance, each burner assembly 124 may have a dedicated valve 206 through which a supply of fuel (e.g., gas) is controlled or regulated (e.g., via knobs 134). Each valve 206 may be fixed to the manifold pipe 202 (e.g., via one or more fasteners 208 or as is otherwise understood). In some instances, each valve 206 is fluidly coupled to the manifold pipe 202 such that manipulation of valve 206 (e.g., via knob 134) restricts or increases the flow or supply of fuel to a respective burner assembly 124 (e.g., by restricting or increasing the size of an opening or aperture between manifold pipe 202 and the respective burner assembly 124). Thus, each valve 206 may include a valve stem or post 210 extending generally away from range appliance 100 (e.g., through the manifold panel 116, such as seen in FIG. 6).

The gas manifold assembly 200 may include a switch harness 212. Switch harness 212 may be selectively coupled to each of the plurality of valves 206. In detail, switch harness 212 may include a plurality of switches 214 attached to each other via one or more wires 216. Each respective switch 214 may fit over a respective valve stem 210 (e.g., along the transverse direction D). Each switch 214 may be operably connected with a respective valve 206. For one example, each respective switch 214 is snap fit onto each respective valve stem 210. Additionally or alternatively, each respective switch 214 may be operably coupled to a respective knob 134. For instance, switch 214 may send electrical signals related to user inputs at knob 134 to controller 130. According to at least one example, switch 214 detects or senses an input to knob 134 (e.g., a twist, a push, a touch, etc.) and relays the input to controller 130. Switch 214 may therefore be physically connected with knob 134, according to specific embodiments.

Switch harness 212 may include a connector 218. Connector 218 may allow for switch harness 212 to be connected to controller 130. Connector 218 may be an electrical connector 218 (e.g., including one or more conductive prongs) for allowing electrical communication between switch harness 212 and controller 130. For instance, connector 218 may provide an electrical connection between switch harness 212 and controller 130. Additionally or alternatively, connector 218 may provide a physical connection between switch harness 212 and range appliance 100. Advantageously, a user may unplug connector 218 to remove switch harness 212 from valve stems 210.

In addition, the manifold pipe 202 may include a first end portion 220 and a second end portion 222. The first end portion 220 and the second end portion 222 may be spaced apart approximately along the lateral direction W. The first end portion 220 may include approximately fifty percent (50%) of the width (e.g., as measured approximately along the lateral direction W) of the manifold pipe 202. For instance, the first end portion 220 of the manifold pipe 202 may be measured from a first lateral end of the manifold pipe 202 to a lateral center of the manifold pipe 202. Similarly, the second end portion 222 may also include approximately fifty percent (50%) of the width (e.g., as measured approximately along the lateral direction W) of the manifold pipe 202. For instance, the second end portion 222 of the manifold pipe 202 may be measured from a second lateral end of the manifold pipe 202 to the lateral center of the manifold pipe 202.

The gas manifold assembly 200 may include one or more bracket assemblies 224 (e.g., a first bracket assembly and a second bracket assembly as illustrated in FIG. 3). In some embodiments, the first bracket assembly may be attached to the first end portion 220 of the manifold pipe 202 and the second bracket assembly may be attached to the second end portion 222 of the manifold pipe 202. In this regard, a discrete bracket assembly 224 may be positioned on either lateral side of the manifold pipe 202. As will be appreciated in more detail below, the pair of bracket assemblies 224 may each include locating features that advantageously improve or ensure correct installation of one or more components of the cooktop assembly 112 or the gas manifold assembly 200.

It should be appreciated that the number and the location of the bracket assemblies 224 may be provided by way of example only. For instance, in some other exemplary embodiments, the gas manifold assembly 200 may include any suitable number of bracket assemblies 224 attached to the manifold pipe 202. For example, the gas manifold assembly 200 may include two or more bracket assemblies, such as three bracket assemblies 224, attached the manifold pipe 202. For instance, the manifold pipe 202 may include a third bracket assembly attached at a center portion of the manifold pipe 202.

Figure 5:
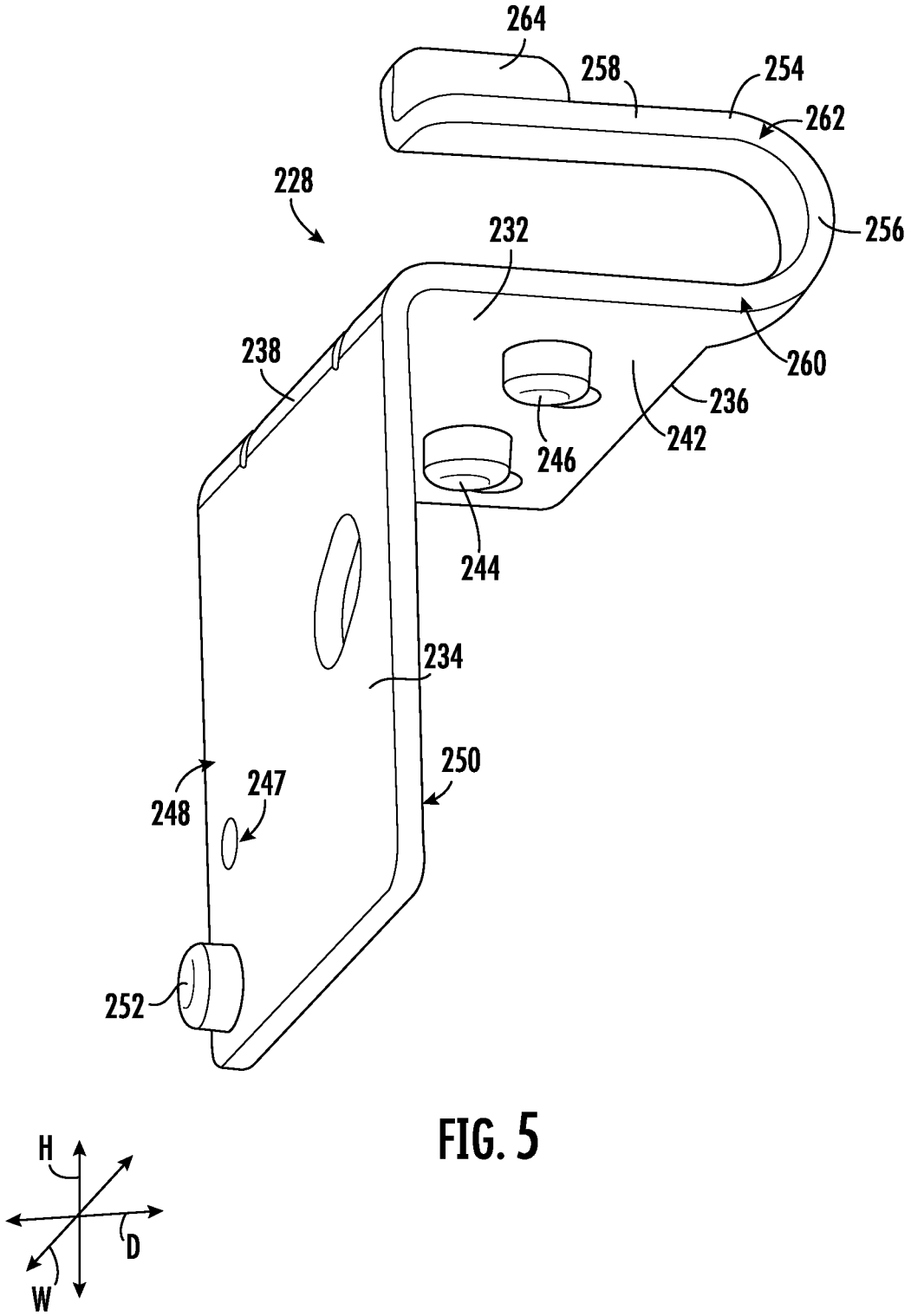
FIG. 5 provides a bottom perspective view of a panel bracket of the exemplary bracket assembly of FIG. 4.

Referring now to FIGS. 4 and 5 perspective views of the discrete bracket assembly 224 are provided. Specifically, FIG. 4 provides a close-up perspective view of the discrete bracket assembly 224 attached to the manifold pipe 202 and FIG. 5 provides a bottom perspective view of a panel bracket 228 of the discrete bracket assembly 224. As should be appreciated, only a singular (e.g., discrete) bracket assembly 224 is described in more detail below. However, one of ordinary skill in the art would recognize that the structure and function of any additional bracket assembly that may be attached to the manifold pipe 202 may be identical to that of the discrete bracket assembly 224 illustrated.

The bracket assembly 224 may include a manifold bracket 226 and a panel bracket 228. In some embodiments, the manifold bracket 226 is directly coupled or fixed to the manifold pipe 202. For instance, the manifold bracket 226 may be welded to the manifold pipe 202 (e.g., to a top surface thereof). Further, the manifold bracket 226 may include a first aperture 229 defined therethrough and a second aperture 231 defined therethrough. In some embodiments, the panel bracket 228 is removably coupled to the manifold bracket 226. For instance, the panel bracket 228 may be attached directly to the manifold pipe 202 via one or more fasteners 230 (e.g., screws, adhesives, hook and loop, magnets, etc.).

In some embodiments, the panel bracket 228 includes a first flange 232 and second flange 234. The first flange 232 may be removably coupled to the manifold bracket 226. For instance, the first flange 232 may be attached to the manifold bracket 226 via one or more fasteners 230. Further, the first flange 232 may be extended between a first end 236 and a second end 238 approximately along the transverse direction D. In some embodiments, the first flange 232 includes a first face 240 (e.g., FIG. 4) and a second face 242 (e.g., FIG. 5) spaced apart approximately along the vertical direction H.

In addition, the panel bracket 228 may include one or more locating features that locate components the gas manifold assembly 200 together or the gas manifold assembly 200 to the cooktop assembly 112 (e.g., during assembly or maintenance of the range appliance 100). In some embodiments, the one or more locating features include a first vertical locating pin 244 and a second vertical locating pin 246 (e.g., FIG. 5). The first vertical locating pin 244 and the second vertical locating pin 246 may each be extended from the second face 242 of the first flange 232 approximately along the vertical direction H. For instance, the first vertical locating pin 244 and the second vertical locating pin 246 may be extended downward approximately along the vertical direction H. The first aperture 229 defined through the manifold bracket 226 may be matched or aligned with the first vertical locating pin 244 approximately along the vertical direction H. The second aperture 231 defined through the manifold bracket 226 may be matched or aligned with the second vertical locating pin 246 approximately along the vertical direction H. The first vertical locating pin 244 and the second vertical locating pin 246 may be located within the first aperture 229 and the second aperture 231, respectively, when panel bracket 228 is attached to manifold bracket 226. Thus, the panel bracket 228 may advantageously be accurately and easily located with respect to manifold bracket 226 and, thus, with respect to manifold pipe 202 and each valve 206.

The second flange 234 may be extended from the second end 238 of the first flange 232 approximately along the vertical direction H. In some embodiments, the second flange 234 includes a first face 248 and a second face 250. The first face 248 and the second face 250 of the second flange 234 may be spaced apart approximately along the transverse direction D. Additionally or alternatively, the one or more locating features of the panel bracket 228 may include a horizontal locating pin 252 that may be extended from the first face 248 of the second flange 234 approximately along the transverse direction D. The cooktop assembly 112, and more particularly, the manifold panel 116 of the cooktop assembly 112, may include a first cooktop aperture 117 defined through the manifold panel 116 (e.g., FIG. 6). The first cooktop aperture 117 may be matched or aligned with the horizontal locating pin 252 approximately along the transverse direction T. Thus, the manifold panel 116 of the cooktop assembly 112 may be aligned with respect to the panel bracket 228 (and, coincidentally, manifold pipe 202 and valves 206) when the manifold panel 116 is attached to the range appliance 100.

In some embodiments, the one or more locating features also include a locating hook 254. Generally, the locating hook 254 may be interfaced with the cooktop return flange 122 to locate the gas manifold assembly 200 to the cooktop assembly 112 (e.g., during assembly or maintenance of the range appliance 100). The locating hook 254 may include an arc member 256 and a first member 258 extended approximately along the transverse direction D. The arc member 256 may include a first end 260 and a second end 262. In some embodiments, the arc member 256 is extended from the first flange 232 to the first member 258. For instance, the arc member 256 may curve from the first end 260 attached to the first flange 232 to the second end 262 attached to the first member 258. Additionally, in some embodiments, the one or more locating features includes a locating tab 264. The locating tab 264 may be extended from the locating hook 254 approximately along the vertical direction H. For instance, the locating tab 264 may be extended from the first member 258 of the locating hook 254 upwards approximately along the vertical direction H.

Referring now to FIG. 6, a cutaway view of the exemplary range appliance 100 of FIG. 1 is provided. As described above, embodiments of the present subject matter advantageously provide bracket assemblies 224 for the gas manifold assembly 200. Each bracket assembly 224 may include one or more locating features (e.g., the locating hook 254, the locating tab 264, the vertical locating pins 244, 246 or the horizontal locating pin 252). The one or more locating features may be utilized to ensure correct installation of the gas manifold assembly or the manifold panel during assembly or maintenance operations. For instance, assembly or maintenance operations may include the mounting or servicing of the gas manifold assembly 200 or the cooktop assembly 112, and more particularly, components thereof such as the manifold panel 116. Additionally, the one or more locating features ensures correct re-installation of the gas manifold assembly or manifold panel after a servicing operation. For instance, the locating hook 254 may function as a poka-yoke feature that enables proper installation or re-installation of the gas manifold assembly 200 or the manifold panel 116.

During installation or re-installation of the gas manifold assembly 200, an operator may position the first member 258 of the locating hook 254 such that it is above a top surface of the cooktop return flange 122 (e.g., as illustrated in FIG. 6). Further, when the operator releases the gas manifold assembly 200 (e.g., prior to attaching the manifold panel 116 to the gas manifold assembly 200), the first member 258 may interface with the cooktop return flange 122 to prevent or mitigate the sagging of the gas manifold assembly 200 relative to the cooktop 114. In this regard, when the operator attaches the manifold panel 116 to the gas manifold assembly 200, the valve stems 210 may fit through teardrop cooktop apertures 119 defined through the manifold panel 116 and the horizontal locating pin 252 may easily be located to the first cooktop apertures 117.

Additionally or alternatively, the locating tab 264 may function as a poka-yoke feature that prevents improper installation or re-installation of the gas manifold assembly 200 or the manifold panel 116. Particularly, if an operator mistakenly positions the first member 258 of the locating hook 254 such that it is below a bottom surface of the cooktop return flange 122, the locating tab 264 may interface with the bottom surface of the cooktop return flange 122 to prevent improper installation or re-installation. In particular, this may lower the gas manifold assembly 200 (e.g., approximately along the vertical direction V) such that the valve stems 210 may not properly fit through the teardrop cooktop apertures 119. Additionally or alternatively, this may prevent a fastener aperture 133 defined through the manifold panel 116 and a fastener hole 247 (see, e.g., FIGS. 4 and 5) defined through the panel bracket 228 from aligning approximately along the transverse direction T. In this regard, an operator may be prevented from driving a fastener 131 through the fastener aperture 133 and the fastener hole 247 (e.g., to attach manifold panel 116 to panel bracket 228).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A range appliance defining a vertical direction, a lateral direction, and a transverse direction, the range appliance comprising:

a cabinet defining a cooking chamber;

a cooktop assembly positioned at a top portion of the cabinet, the cooktop assembly comprising a cooktop, the cooktop comprising a cooktop front panel extending along the vertical direction, and a cooktop return flange extending from the cooktop front panel along the transverse direction; and a gas manifold assembly provided at the cooktop assembly, the gas manifold assembly comprising:

a manifold pipe through which fuel is supplied to the cooktop assembly; and a bracket assembly comprising a manifold bracket and a panel bracket, the manifold bracket directly coupled to the manifold pipe, the panel bracket removably coupled to the manifold bracket, wherein the panel bracket comprises one or more locating features to locate the gas manifold assembly to the cooktop assembly, and wherein the one or more locating features comprises a locating hook interfaced with the cooktop return flange to locate the gas manifold assembly to the cooktop assembly.

2. The range appliance of claim 1, wherein the manifold pipe comprises a first end portion and a second end portion spaced apart approximately along the lateral direction, wherein the bracket assembly is a first bracket assembly attached to the first end portion of the manifold pipe, and wherein the gas manifold assembly further comprises a second bracket assembly attached to the second end portion of the manifold pipe.

3. The range appliance of claim 1, wherein the panel bracket comprises a first flange and a second flange, wherein the first flange comprise a first end and a second end spaced apart approximately along the transverse direction, and wherein the second flange is extended from the second end of the first flange approximately along the vertical direction.

4. The range appliance of claim 3, wherein the locating hook is positioned at the first end of the panel bracket.

5. The range appliance of claim 4, wherein the first flange comprises a first side and a second side spaced apart approximately along the lateral direction, and wherein the locating hook is positioned at the second side of the panel bracket.

6. The range appliance of claim 4, wherein the locating hook comprises an arc member and a first member, wherein the arc member comprises a first end and a second end, wherein the first end of the arc member is attached to the first end of the first flange, and wherein the second end or the arc member is attached to the first member.

7. The range appliance of claim 4, wherein the one or more locating features further comprises a locating tab extended upward from the locating hook approximately along the vertical direction.

8. The range appliance of claim 3, wherein the first flange comprises a first face and a second face spaced apart approximately along the vertical direction, wherein the one or more locating features further comprises a first vertical locating pin and a second vertical locating pin, and wherein the first vertical locating pin and the second vertical locating pin are each extended from the second face of the first flange approximately along the vertical direction.

9. The range appliance of claim 8, wherein the manifold bracket defines a first aperture and a second aperture, wherein the first aperture is aligned with the first vertical locating pin along the vertical direction, and wherein the second aperture is aligned with the second vertical locating pin approximately along the vertical direction.

10. The range appliance of claim 3, wherein the second flange comprises a first face and a second face spaced apart approximately along the transverse direction, wherein the one or more locating features further comprises a horizontal locating pin, and wherein the horizontal locating pin is extended from the first face of the second flange approximately along the transverse direction.

11. The range appliance of claim 10, wherein the cooktop assembly comprises a manifold panel and a first cooktop aperture defined through the manifold panel, and wherein the first cooktop aperture is aligned with the horizontal locating pin approximately along the transverse direction.

12. A gas manifold assembly for a range appliance, the range appliance defining a vertical direction, a lateral direction, and a transverse direction, the range appliance comprising a cabinet defining a cooking chamber and a cooktop assembly positioned at a top portion of the cabinet, the cooktop assembly comprising a cooktop front panel extending along the vertical direction and a cooktop return flange extending from the cooktop front panel along the transverse direction, the gas manifold assembly comprising:

a manifold pipe through which fuel is supplied to the cooktop assembly; and a bracket assembly comprising a manifold bracket and a panel bracket, the manifold bracket directly coupled to the manifold pipe, the panel bracket removably coupled to the manifold bracket, wherein the panel bracket comprises one or more locating features to locate the gas manifold assembly to the cooktop assembly, and wherein the one or more locating features comprises a locating hook interfaced with the cooktop return flange to locate the gas manifold assembly to the cooktop assembly.

13. The gas manifold assembly of claim 12, wherein the manifold pipe comprises a first end portion and a second end portion spaced apart approximately along the lateral direction, wherein the bracket assembly is a first bracket assembly attached to the first end portion of the manifold pipe, and wherein the gas manifold assembly further comprises a second bracket assembly attached to the second end portion of the manifold pipe.

14. The gas manifold assembly of claim 12, wherein the panel bracket comprises a first flange and a second flange, wherein the first flange comprise a first end and a second end spaced apart approximately along the transverse direction, and wherein the second flange is extended from the second end of the first flange approximately along the vertical direction.

15. The gas manifold assembly of claim 14, wherein the locating hook is positioned at the first end of the panel bracket.

16. The gas manifold assembly of claim 15, wherein the first flange comprises a first side and a second side spaced apart approximately along the lateral direction, and wherein the locating hook is positioned at the second side of the panel bracket.

17. The gas manifold assembly of claim 15, wherein the locating hook comprises an arc member and a first member, wherein the arc member comprises a first end and a second end, wherein the first end of the arc member is attached to the first end of the first flange, and wherein the second end or the arc member is attached to the first member.

18. The gas manifold assembly of claim 15, wherein the one or more locating features further comprises a locating tab extended upward from the locating hook approximately along the vertical direction.

19. The gas manifold assembly of claim 14, wherein the first flange comprises a first face and a second face spaced apart approximately along the vertical direction, wherein the one or more locating features further comprises a first vertical locating pin and a second vertical locating pin, and wherein the first vertical locating pin and the second vertical locating pin are each extended from the second face of the first flange approximately along the vertical direction.

20. The gas manifold assembly of claim 14, wherein the second flange comprises a first face and a second face spaced apart approximately along the transverse direction, wherein the one or more locating features further comprises a horizontal locating pin, and wherein the horizontal locating pin is extended from the first face of the second flange approximately along the transverse direction.

* * * * *